US005776014A

United States Patent [19]

Gustine

[11] Patent Number: 5,776,014

[45] Date of Patent: Jul. 7, 1998

[54] ADJUSTABLE GOLF BALL TEE

[76] Inventor: Floyd L. Gustine, 5631 Curry Rd., Pittsburgh, Pa. 15236

[21] Appl. No.: 774,947

[22] Filed: Dec. 27, 1996

[51] Int. Cl.[6] ..... A63B 57/00

[52] U.S. Cl. ..... 473/396; 473/387

[58] Field of Search ..... 473/387, 391, 473/396, 398, 400, 401, 402, 132, 133, 134, 135, 136, 137

[56] References Cited

U.S. PATENT DOCUMENTS

| | | | |
|---|---|---|---|
| 1,929,579 | 10/1933 | Garlando | 473/398 |
| 2,127,282 | 8/1938 | Beckett | 473/137 |
| 2,450,206 | 9/1948 | Shouse | 473/133 |
| 3,147,980 | 9/1964 | Gollahon | 473/134 |
| 3,516,664 | 6/1970 | Brennan | 473/402 |

*Primary Examiner*—Steven B. Wong
*Attorney, Agent, or Firm*—Clifford A. Poff

[57] ABSTRACT

An adjustable golf ball tee for teeing up a golf ball in a playing field includes an elongated support provided with a golf ball support surface and a base at opposite ends. The base is received in the cavity of a receiver housing which supports a nut member to threadably receive the threaded portion of a screw. The head portion of the screw is integrally surrounded by plastic material comprising the base of the golf ball support. The terminal end of the screw is provided with a jam nut that limits the extent at which the screw threads can be withdrawn from the nut in the cavity of the receiver. A cap is fitted onto the lower end of the receiver to prevent the ingress of foreign material and a bevel at the lower end of the receiver anchors it against rotation in a bored hole extending beneath the playing field.

7 Claims, 1 Drawing Sheet

ADJUSTABLE GOLF BALL TEE

BACKGROUND OF THE INVENTION

1. Field of the Invention

The present invention relates to a golf ball tee for supporting a golf ball above a playing field, and, more particularly to a golf ball tee embodying a construction and arrangement of parts for adjustably positioning a golf ball support surface at a height selected within a range of adjustment by an elevating mechanism.

2. Description of the Prior Art

As is well known in the art, it is a common practice to use a tee, usually made of wood, to support a golf ball at a preselected height above a playing field so that a golf club can be impacted with a golf ball. This mode of driving a golf ball is practiced at a teeing area as well as at a driving range, for example. The extent of adjustment to the height of the golf ball above the playing field is limited by the height of the tee and the soil conditions which govern the length of the shank of the tee extending beneath the golf ball support surface which must penetrate the earth to obtain a stable support. A golf ball tee of this type is inexpensive and constructed so that it can be lost without usually any desire to recover the tee in the event the tee is dislodged from the playing surface upon impact with the golf club. At a driving range where golfers practice driving golf balls for distance and accuracy, the golf ball is usually supported by a permanent structure either generally level with the playing field or at a fixed height above it. The golfer cannot vary the height at which the golf ball is supported above the playing field. It is desirable to practice driving techniques to simulate driving golf balls both from the tee box where the golf ball is usually located above the playing field as well as from a fairway and of course sometimes, in the taller grass in the rough where a golf ball tee should not be used and thus the golf ball must be hit while supported by the playing field. A need therefore exists for an adjustable golf ball tee operable to support a golf ball at a height that can be selected from a range between a position generally level with the playing field or an extended position which is free and clear above the playing field.

It is an object of the present invention to provide an improved golf ball tee embodying a construction which includes a height adjustor which allows a golf ball support surface to be located at a position where the golf ball might be supported by the playing field and an elevated position which can be, by way of example only, one inch or greater above the playing field.

It is another object of the present invention to provide an adjustable golf tee made up of a combination of parts forming an assembly which can be installed as a unit in an opening below grade of a playing field for service and replacement of the unit used to allow a golf ball support surface to selectively project at any of a variety of distances within a predetermined range above the playing field.

It is a further object of the present invention to provide an adjustable golf tee useful for supporting a golf ball at the level of, or above, a playing field which can be for practice or for playing the game of golf.

SUMMARY OF THE INVENTION

According to the present invention there is provided an adjustable golf tee for teeing up a golf ball above a playing field, the adjustable golf tee including the combination of a golf ball support having a golf ball support surface at one end of an elongated section, a receiver supported in a cavity beneath such a playing field having an internal cavity for guiding and supporting the golf ball support, and a height adjustor operably connecting the golf ball support to the receiver for providing adjustment to the relative distance between the golf ball support surface and such a playing field.

More particularly in the preferred form of the present invention there is provided an adjustable golf tee for teeing up a golf ball above a playing field, the adjustable golf tee including the combination of an elongated golf ball support having a golf ball support surface and a base at opposite ends thereof, a threaded carrier extending from the base in a direction opposite to the golf ball support surface, a receiver supported in a cavity beneath such a playing field, the receiver having an internal cavity for guiding and supporting the elongated golf ball support, and a threaded nut positioned within the internal cavity of the receiver to threadable receive the threaded carrier for adjustably positioning the golf ball support surface at a predetermined distance beyond the receiver and above such a playing field. It is preferred to provide a stop member on the end portion of the aforementioned threaded carrier to fix and limit the extent to which the elongated golf ball support can project above the playing field.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
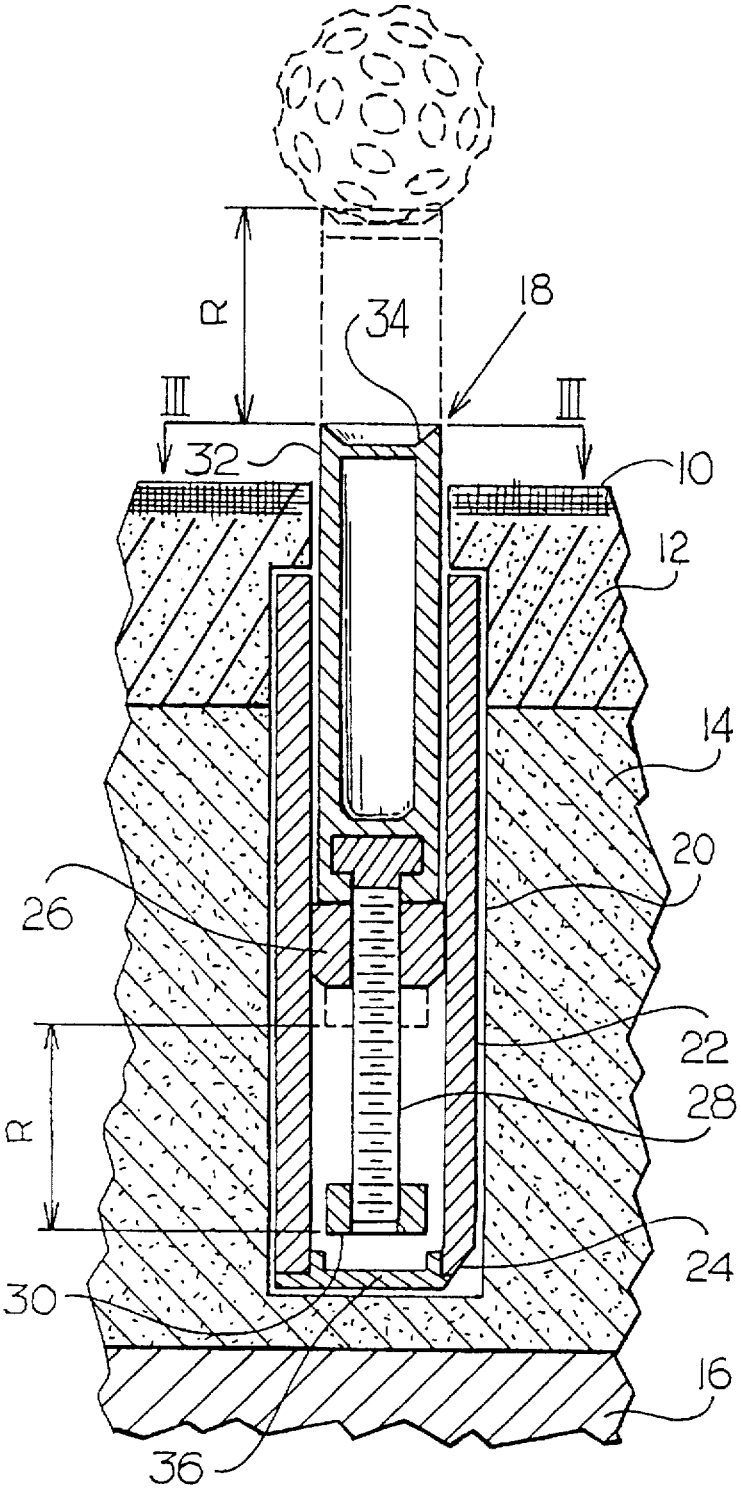
FIG. 1 is an elevational view in section illustrating the construction of the adjustable golf ball tee arranged below grade to a playing field according to the present invention.

For the purposes of disclosing the preferred embodiment of the present invention, the application of an adjustable golf ball tee to a driving range has been selected and, as shown in FIG. 1, there is a playing field 10 formed by a layer of artificial turf. A rubber sponge mat 12 supports the turf upon a platform 14 comprising asphalt or cement. The platform 14 in turn, is supported by earth 16. The present invention provides an adjustable golf tee in the form of an assembly 18 that is inserted as a unit into an aperture 20 typically formed by a drilling operation to form a bored hole of a diameter sufficient to receive and support the outer cylindrical surface of a tee housing 22 which forms a receiver that extends in the cavity beneath the playing field.

Figure 2:
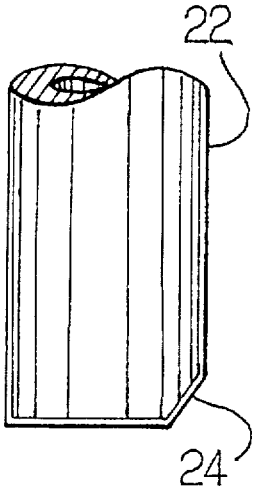
FIG. 2 is a fragmentary view taken along lines II—II of FIG. 1.

As shown in FIGS. 1 and 2, the lower terminal end portion of the tee housing 22 is provided with a beveled surface 24 in the form of an upwardly inclined planar surface that extends transversely to the extended length of the housing. The beveled surface 24 serves to form a pocket at the bottom of the cavity formed by the aperture 20 to receive filler material that is inserted into a void between the outer cylindrical surface of the housing 22 and the face surface of the aperture 20. The filler material anchors the tee housing against inadvertent removal from the aperture and prevents relative rotation of the housing within the aperture. The filler material may take the form of an adhesive to serve as a positive binder or as a finely divided material such as sand that will compact to act as a wedge in and about the beveled surface and thereby prevent the unwanted rotation. A stop nut 26 is anchored preferably by an interference fit within an internal cavity formed within housing 22. The stop nut is positioned a predetermined distance from the lower end of housing 22 to threadably receive the shank portion of a hex-head all threaded machine screw 28.

As shown in FIG. 1, the portion of the machine screw 28 which extends downwardly from the stop nut 26 is fitted with a stop nut 30 that serves to prevent unwanted unthreading of the screw 28 from the nut 26. Nut 30 is firmly secured to the lower end of the threaded shaft part of screw 28 by thread jamming which is accomplished in one manner by providing screw 28 with 20 threads per inch and nut 30 with 28 threads per inch. By providing that the threads are the same pitch diameters, a "cross setting" will occur that securely holds nut 30 to the threads of the screw. The nut 30 serves the important function of preventing an unwanted retraction of the threaded screw 28 from the minimum height stop nut 26 and thus prevents accidental dislodgment of the golf tee from the housing 22. Nut 26 functions to establish the maximum height to which a flexible adjustable driving golf tee 32 may extend from the aperture in which it is supported.

Figure 3:
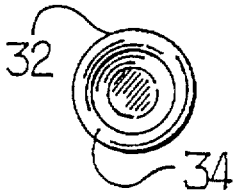
FIG. 3 is a plan view taken along lines III—III of FIG. 1.

The end of the tee 32 which is opposite the golf ball support surface has a base which forms a site for receiving the head portion of the screw 28. The golf tee has an upper surface 34 with a cup-shaped configuration forming a golf ball support surface which is best shown in FIGS. 1 and 3. The golf tee is preferably made from molded plastic, such as nylon or synthetic rubber, having a durometer reading of 60 Shore (A) or less, preferably in the range of 50 to 60. Also, as shown in FIG. 1, the golf tee 32 has a tapered side wall thickness which establishes a desired flexibility to avoid damage to a driver, or other club, while insuring restoration of the shape and position of the golf tee 32. In order to prevent the ingress of dirt, debris and other foreign materials, the lower end of the housing is fitted with a cap 36. It is to be understood that while a threaded bolt and stop nuts have been chosen for the preferred embodiments of the present invention to allow a user to select any of a variety of heights at which a golf ball may be supported above a playing surface, other forms of height adjustors may be operatively connected between flexible adjustable golf tee 32 and the housing 22 forming the receiver for the tee. In FIG. 1 the letter "R" denotes the range to the variety of height at which the golf ball may be supported above the playing field. This range can be extended or shortened by choosing a correspondingly longer or shorter length of the screw 28 between stop nut 26 and nut 30.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An adjustable golf ball tee assembly receivable in an elongated annular cavity beneath a playing field for teeing up a golf ball above the playing field, the adjustable golf ball tee including the combination of:

a golf ball support having a golf ball support surface and a base at opposite ends thereof, said support being elongated by a distance sufficient to support a golf ball on the golf ball support surface within a selectable range of elevations above such a playing field;

a threaded carrier extending from the base of said golf ball support in a direction opposite to said golf ball support surface, said threaded carrier being elongated by a distance sufficient to position said golf ball support surface within said selectable range;

a receiver including an anchoring surface for support and retention against movement in such elongated annular cavity beneath such a playing field, said receiver having an internal cavity for guiding and supporting said elongated golf ball support through said range of elevations; and a threaded nut affixed within the internal cavity of said receiver to threadably receive and vertically displace said threaded carrier within said range of elevations, the range being predetermined by the amount of extension of said threaded carrier with respect to the threaded nut.

2. The adjustable golf ball tee according to claim 1 further including a stop secured to said threaded carrier at a spaced relation to said threaded nut.

3. The adjustable golf ball tee according to claim 1 wherein said elongated golf ball support consists of an elastic material to allow flexing thereof when a golf ball supported thereby is struck with a golf club.

4. The adjustable golf ball tee according to claim 2 wherein said elastic material has a durometer reading of 60 or less.

5. The adjustable golf ball tee according to claim 4 wherein the durometer reading is between 50 and 60.

6. The adjustable golf ball tee according to claim 1 further including a cap fitted onto said receiver at an end which is opposite to the end which receives said elongated golf ball support to prevent the ingress of materials to the internal cavity of the receiver.

7. The adjustable golf ball tee according to claim 1 wherein said surface to receive material comprises a planar upwardly inclined surface that extends transversely to the extended length of said receiver.

* * * * *